US006630043B2

(12) United States Patent
Sloot

(10) Patent No.: US 6,630,043 B2
(45) Date of Patent: Oct. 7, 2003

(54) PLASTIC TRIMMED FABRIC PRODUCT AND METHOD OF MANUFACTURING THE SAME

(75) Inventor: Alexander Sloot, Sugarloaf, PA (US)

(73) Assignee: Printmark Industries, Inc., Hazelton, PA (US)

( * ) Notice: Subject to any disclaimer, the term of this patent is extended or adjusted under 35 U.S.C. 154(b) by 165 days.

(21) Appl. No.: 09/769,102

(22) Filed: Jan. 25, 2001

(65) Prior Publication Data

US 2003/0017772 A1 Jan. 23, 2003

(51) Int. Cl.[7] ..... D03D 47/50; D06C 25/00

(52) U.S. Cl. ..... 156/73.1; 156/88; 156/267; 156/275.5

(58) Field of Search ..... 156/88, 73.1, 230, 156/267, 272.2, 275.1, 275.5, 289, 304.4, 304.3; 427/289

(56) References Cited

U.S. PATENT DOCUMENTS 3,895,160 A * 7/1975 Seeman, II ..... 156/178
3,901,579 A * 8/1975 Demerest ..... 2/326
3,977,322 A * 8/1976 Jaffa ..... 101/126
4,655,868 A * 4/1987 Hefele ..... 156/238
4,750,884 A * 6/1988 Bourgeois et al. ..... 402/13
5,472,547 A * 12/1995 McKye et al. ..... 156/250
5,552,472 A * 9/1996 Kerr et al. ..... 524/500
5,934,190 A * 8/1999 Jessup et al. ..... 101/127.1
5,981,034 A * 11/1999 Gray et al. ..... 156/88
5,992,315 A * 11/1999 Lorenz ..... 101/128.1
6,136,120 A * 10/2000 Stewart et al. ..... 156/308.4
2002/0079039 A1 * 6/2002 Azulay ..... 156/73.1

* cited by examiner

*Primary Examiner*—Curtis Mayes
*Assistant Examiner*—Cheryl N. Hawkins
(74) *Attorney, Agent, or Firm*—St. Onge Steward Johnston & Reens LLC

(57) ABSTRACT

A process for manufacturing a fabric product includes providing a layer of fabric; applying a liquid polymeric material to the layer of fabric in accordance with a pre-selected pattern including at least a peripheral area which corresponds to a shape of the fabric product; curing the polymeric material along the peripheral area, thereby polymeric material-strengthening the layer of fabric at least along the peripheral area; and cutting within and through the polymeric material-strengthened peripheral area to shape the layer, thereby forming a plastic seal around a peripheral edge of the shaped layer of fabric.

21 Claims, 7 Drawing Sheets

PLASTIC TRIMMED FABRIC PRODUCT AND METHOD OF MANUFACTURING THE SAME

FIELD OF THE INVENTION

The invention relates to a fabric product created by applying a liquid polymeric material to a layer of fabric in accordance with a predetermined decorative pattern. More particularly, the invention relates to a fabric product in which the peripheral edge of the fabric product is reinforced by a plastic seal formed around this edge to prevent it from fraying.

BACKGROUND OF THE INVENTION

Fabric products such as safety mesh vests, mitts, bibs, tank top and T-shirts are known in the art. Some of these types of products such as the vests are not only attached together during the course of their assembly, but they might have trim such as a type of binding attached along their perimeter or internally as part of joining the various cut parts of fabric together. This trim may be the same or of a contrasting color to the mesh or fabric material used for the body of the wearable.

One of the manufacturing methods for assembling garments, wearables, vests and other fabric products is by means of bonding the cut parts together. Cut parts made for example from a thermoplastic material are generally cut from pre-designed patterns, and then, after applying vinyl trim to the edges of these parts, are bonded together both in solid areas and/or in thin trim-like areas. The fabric product manufactured in accordance with the above-described method eliminates the need for sewing and results in highly wear-resistant products.

However, the use of solid thermoplastic material may render the bonding method described above to be rather relatively time and material consuming because separate parts have to be shaped first, and then the shaped product has to be sealed with the vinyl trim.

A decorative part or parts may be applied to the thus manufactured fabric product. Usually these parts are made from a solid thermoplastic material such as vinyl films, applied to the fabric by means of screen printing, UV radiation, and other methods of embellishment.

The decoration of the fabric product with vinyl films necessitates the need for additional die work, and the vinyl must be carefully stripped out from around the graphic area.

What is desired therefore is a quick, simple, easy way to assemble a fabric product and at the same time eliminate the need for applying solid thermoplastic materials to the edges of the fabric product. In addition what is also desired is a method for decorating the fabric product as this product is being manufactured without the need for using separate parts made of a solid thermoplastic material.

SUMMARY OF THE INVENTION

Accordingly it is an object of the invention to provide a method whereby a fabric product can be assembled in an efficient manner.

Still another object of the invention is to provide a method whereby a plastically reinforced fabric product is diecut.

Still another product of the invention is to provide a method whereby a liquefied thermoplastic material is applied to central regions of the fabric material to provide the fabric product with a decorative pattern while this product is being trimmed.

A further object of the invention is to provide a method whereby a liquefied polymeric material applied to the edge and central areas of the fabric product made of mesh material is capable of remaining in the holes of this material.

Yet another object of the invention is to provide a method whereby a liquefied polymeric material is directly applied and cured on the fabric.

Another object of the invention is to provide a method wherein the liquefied polymeric material is first applied to a transfer paper, and then is heat transferred into the fabric.

A further object of the invention is to provide a fabric product manufactured in accordance with the method of the invention.

Still another object of the invention is to provide an assembly for implementing the method in accordance with the invention.

These and other objects are achieved by sealing off the edge of fabric layer with a liquid polymeric material. After this liquid polymeric material has been cured to form a reinforced peripheral zone of the fabric layer, the latter is diecut through to form a plastically strengthened peripheral edge having a desirable contour of the fabric product.

Particularly, the fabric is first laid down onto a non-stick base such as a Teflon material or a silicone treated release liner. Once the fabric is properly positioned, it can be held down with one of numerous methods such as clamping the fabric into position, wherein a liquid polymeric material is applied.

Application of such liquid polymeric material can be done by means of screen-printing, flow molding, injection molding, evaporation and other application methods. Clearly, the least costly method is screen-printing. The liquid polymeric material is applied onto the fabric in desired areas according to a pre-selected pattern. The liquid-coated fabric is then cured, and the polymeric material film will then set in place, forming a plastic seal around the fabric.

The liquid polymeric material can be applied in sections while the fabric is in roll form, or the fabric is cut into separate pieces, such as rectangles, so the liquid material can be applied to individual pieces. Once the liquid material is cured, the thus reinforced fabric is diecut to assume a desirable shape.

To provide the fabric product with graphics or decorations, the liquid polymeric material can be applied to central areas of the layer of fabric while the peripheral area of this layer is being coated.

BRIEF DESCRIPTION OF THE DRAWINGS

The above and other objects, features and advantages will become more readily apparent from the following detailed description accompanied by the following drawings, in which.

DETAILED DESCRIPTION OF THE DRAWINGS

Referring to FIGS. 1–10, in accordance with the method of the invention, a layer of fabric is supplied at 12 for further reinforcement of the pre-selected areas of this layer with a liquid polymeric material at 8. Different types of the fabric such as mesh material, cotton, nylon, polyester, and blends thereof can successfully meet the requirements of the inventive method. Furthermore, any other material, which is used for manufacturing garments, wearables and other fabric products, is also contemplated within the scope of the present invention, as is a fabric material which may or may not have an opening structure.

Figure 2:
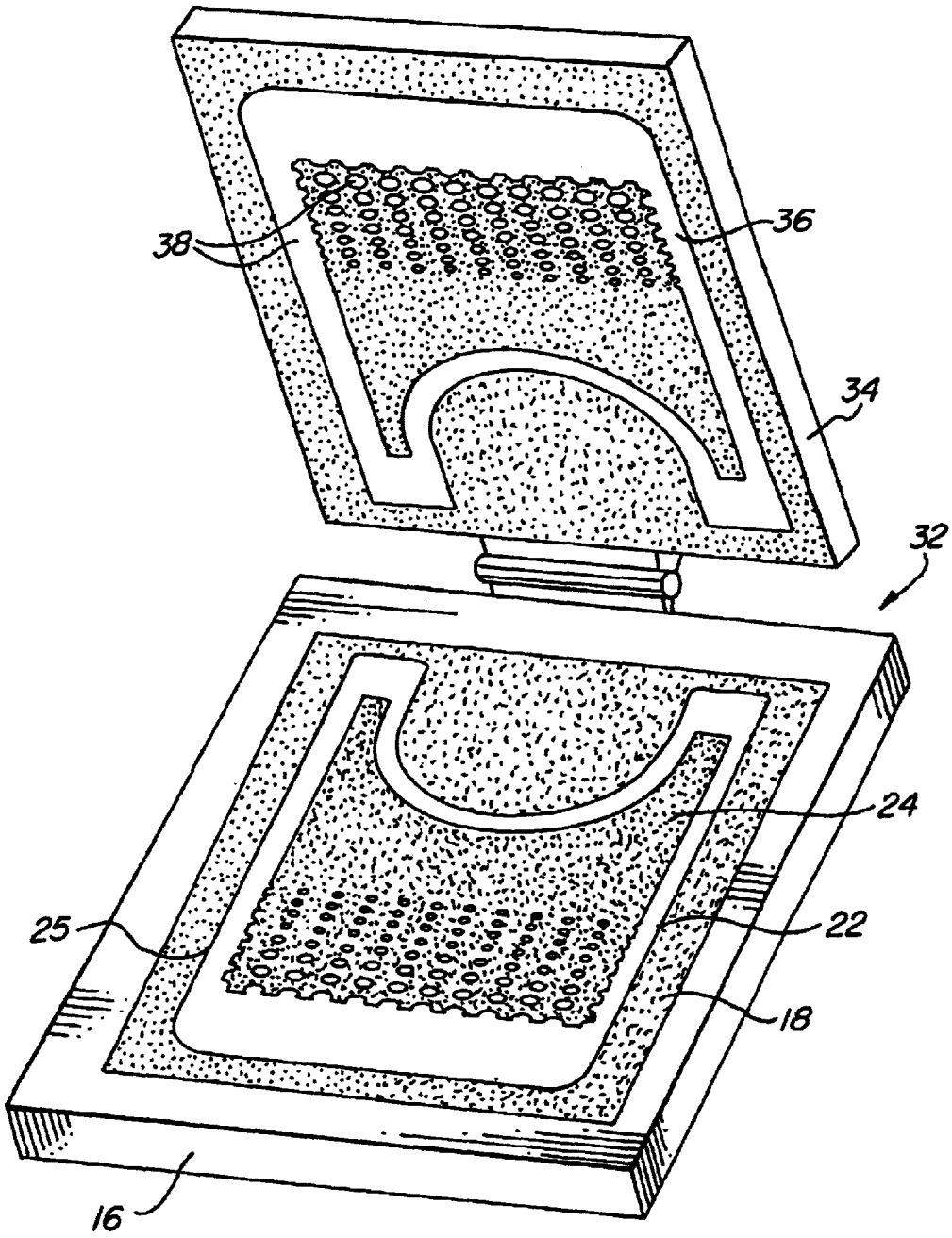
FIG. 2 a perspective view of a screen-printing apparatus for applying a liquid polymeric material in accordance with one of the embodiments of the invention.
Figure 3:
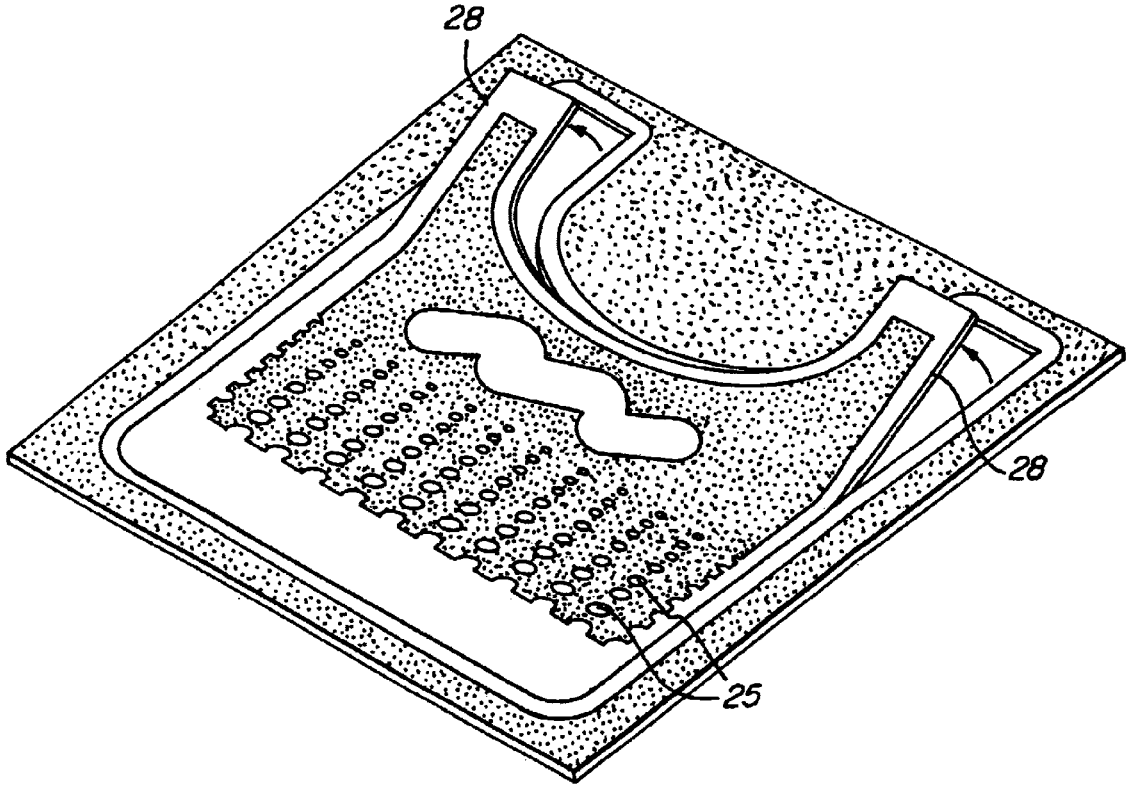
FIG. 3 is a view of fabric provided with a plastic-reinforced vest panel of a fabric product which is manufactured in accordance with the method of the invention.

The polymeric material application station includes a Teflon base 16 (FIG. 2) or a silicone treated release liner which all are characterized by a non-stick surfaces facilitating the removal of the fabric product's parts after they have been reinforced with polymeric material. The fabric can either be continuously fed into position from a fabric roll at 14 or it can be cut to single pieces, each having the same shape such as a rectangular one 18, as shown in FIG. 2. After the fabric is laid down onto the non-stick surface of the base 16, any of numerous methods such as clamping can be used to hold down the delivered fabric in a desirable position at 20.

A liquid polymeric material is applied at 26 (FIG. 1) to the fabric layer in desired areas in accordance with a pre-selected pattern which necessarily includes a peripheral zone 22 (FIG. 2) to prevent an edge of the fabric product from fraying. For example, a vest panel 24 for safety mesh vests typically used by runners and highway workers is defined by the peripheral zone 22 consisting of the fabric layer which is treated with the liquid material. Such liquid plastic material may include plastisol and puff plastisol liquids, UV curable liquids, vinyl liquids, and various types of solvent-based liquids, such as industrial lacquer liquid.

In addition to the peripheral zone, it is easy to apply the liquid material to the middle areas 25 (FIG. 2) of the product in accordance with a limitless variety of designs. The liquid material may be the same or of a contrasting color to the fabric material. As exemplified in FIG. 2, numerous middle regions 25 of the vest panel are differently sized circles of the liquid polymeric material.

Figure 6:
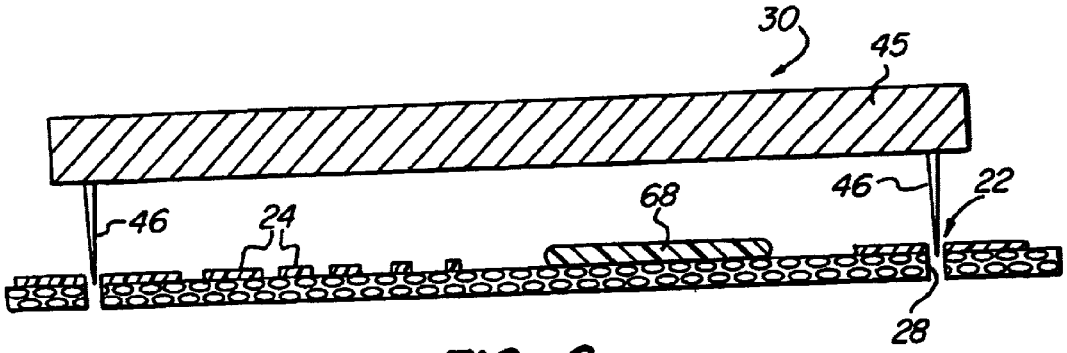
FIG. 6 is a schematic representation of a diecut apparatus in accordance with the invention.

Typically the peripheral zone 22 extends beyond diecut sections limited by a peripheral edge 28 (FIG. 3) which corresponds to an exact shape of the fabric product after it has been diecutted in a die 30 (FIG. 6). Thus, the diecutting will generally be done through the plastic areas, allowing the fabric to be apparent all the way to the edges to help strengthen the plastic-coated peripheral or trim areas.

Numerous methods and techniques such as screen-printing, flow molding, injection molding, and spray-painting can be used for the application of liquid polymeric material to the fabric. The least costly method is screen-printing which can be performed by an apparatus 32 illustrated in FIG. 2.

The apparatus 32 includes the base 16 and a top frame 34 displaceable relative to the base and having a mesh screen 36 provided with open areas 38 through which the liquid material passes onto the fabric in accordance with the pre-designed pattern. One may use a finer or coarser mesh screen to achieve a thin or thick deposit of the liquid material as desired.

Figure 1:
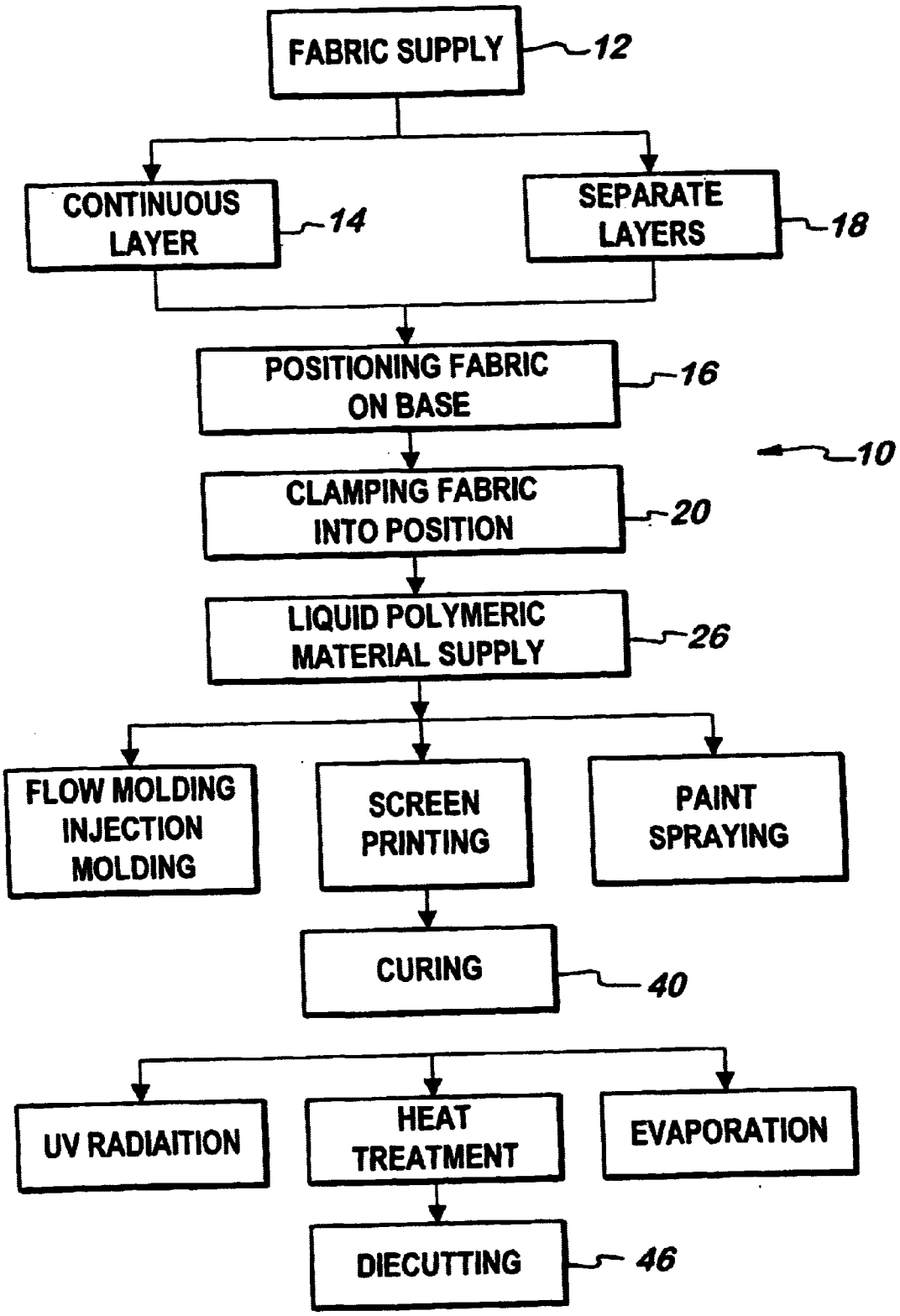
FIG. 1 is a flow chart of the method in accordance with the invention.
Figure 7:
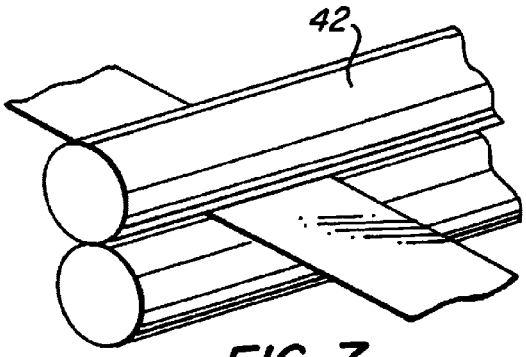
FIG. 7 is a schematic view of nip rollers.

To form a plastic seal around the coated areas of the fabric product and thus to prevent the mesh material from fraying, the liquid material is cured at 40 (FIG. 1). A variety of curing methods can be used to accomplish it. The primary basis for selecting any given method is a type of the liquid polymeric and fabric materials used for the reinforcement purposes. Thus, the plastisol or puff plastisol liquids can be effectively heat cured, which for example can be implemented by press-heating the coated layer of fabric placed between two heated nip-rollers 42 (FIG. 7). Alternatively, the coated layer can be placed between two flat platens similar to the base and top frame of the print-screening apparatus of FIG. 2, but which does not have the mesh screen.

As the coated fabric is heat treated in the heat press, the liquid material is flattened somewhat so it spreads out and is forced sideways to enable the liquid material to be cured to form a plastic seal around the peripheral edge and set in place in the coated central regions. Plastisols generally are equally effective for differently porous materials and cured within a time range between 10 seconds and 1 minute at a temperature varying from 300° F. to 400° F.

If a solvent-based liquid material such as an industrial lacquer is used, then a drying tunnel receiving the coated layer of fabric will be the most appropriate method; whereas a UV curable liquid polymeric material screen printed onto the fabric in a usual manner can be instantly cured under a UV light. However UV materials may not work well on certain very porous fabrics.

Once the coated fabric is cured in a heated drier, it is peeled of the nonstick surface, leaving the excess cured material on the surface. Thus, when a mesh material, which typically is used for vests, is peeled off the non-stick surface after the curing step, the holes will open up.

However, the mesh material can be treated with the liquid polymeric in such a way that the holes remain closed after the curing step. To accomplish it, the coated mesh is placed on the base of a heat press at temperatures 300–400° F. and pressed upon by the top of the press which is also provided with a non-stick surface. The heat press is closed over the mesh/Teflon sandwich for 10 to 15 seconds. As a result of squeezing the coated mesh in the heat press, the liquid material is flattened somewhat so it spreads out and is forced sideways to ultimately bond together and remain in the holes after the polymeric material-reinforced fabric is removed from the base. Such technique can be used for the decorative purposes creating ornamental collages in central areas of the products. Whether the holes are covered or open, the liquid material seals the edges so the fabric will not run or fry.

Figure 9:
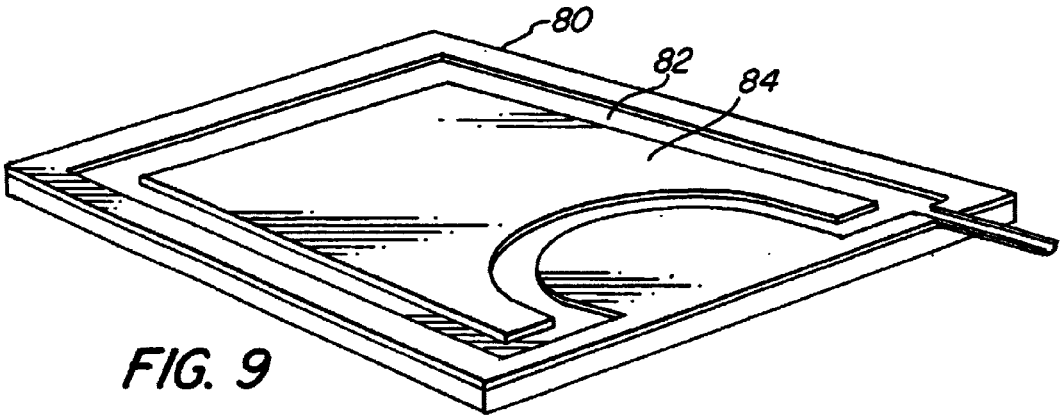
FIG. 9 is a schematic representation of a flow molding station at which a liquid plastic material is applied to fabric.

As has been mentioned before, the application of liquid polymeric material to the fabric can be done by means of a flow molding technique, as diagrammatically shown in FIG. 9. In order to use this technique, a die 80, which may have a lid, is provided with a recess 82 receiving liquid resin or plastisol. After the recess is filled with the liquefied plastic material, the fabric layer is placed in a center area 84 and extends over the recess to have its peripheral zone in contact with the liquefied material. The material is then cured in an oven at 300° to 350° F. for about one minute.

Figure 10:
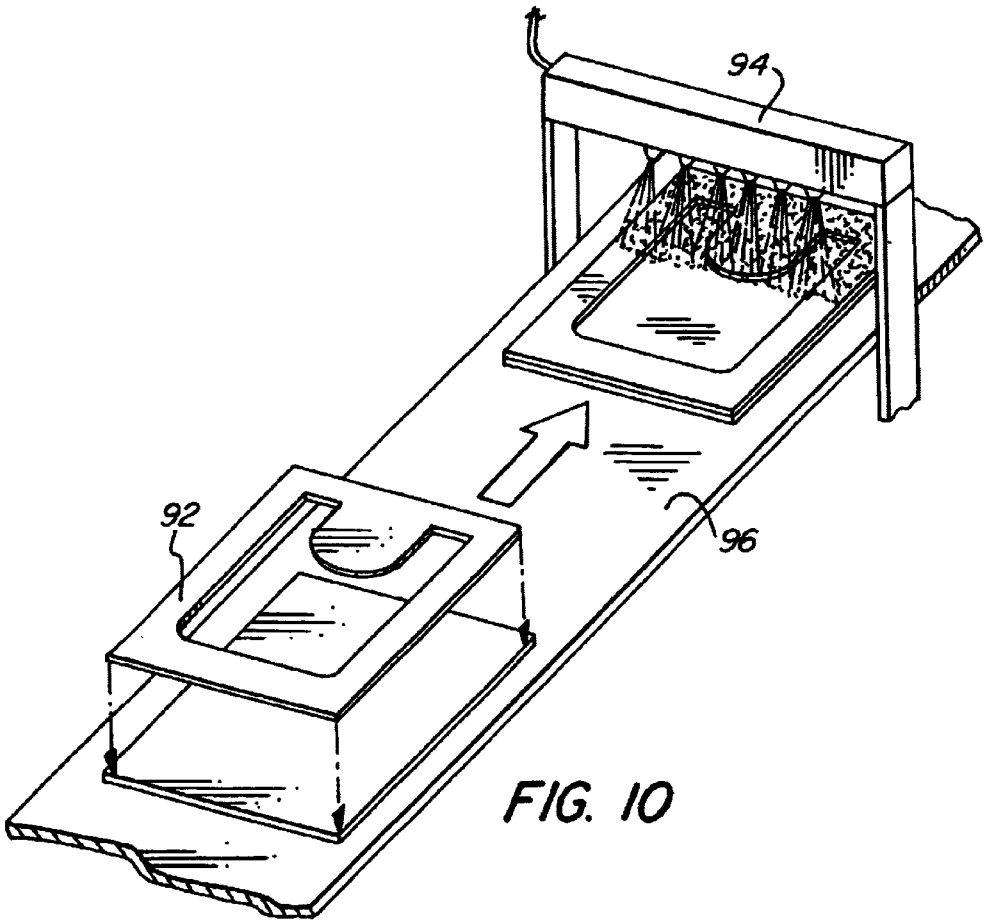
FIG. 10 is a schematic representation of a spray station at which a liquid plastic material is sprayed upon fabric.

Application of liquid material to the fabric by means of a paint spraying technique is illustrated in FIG. 10. The fabric 90 is placed on a conveyor 96 and is a slightly tacky paper mask 92 is placed on the fabric. The mask is pre-diecut to the desired shape: in this case into the shape of a vest. The conveyor will carry the fabric under a spray mechanism 94 and the fabric will be coated with the liquefied plastic material, which is later cured in an oven located along downstream from the spray mechanism.

Figure 4:
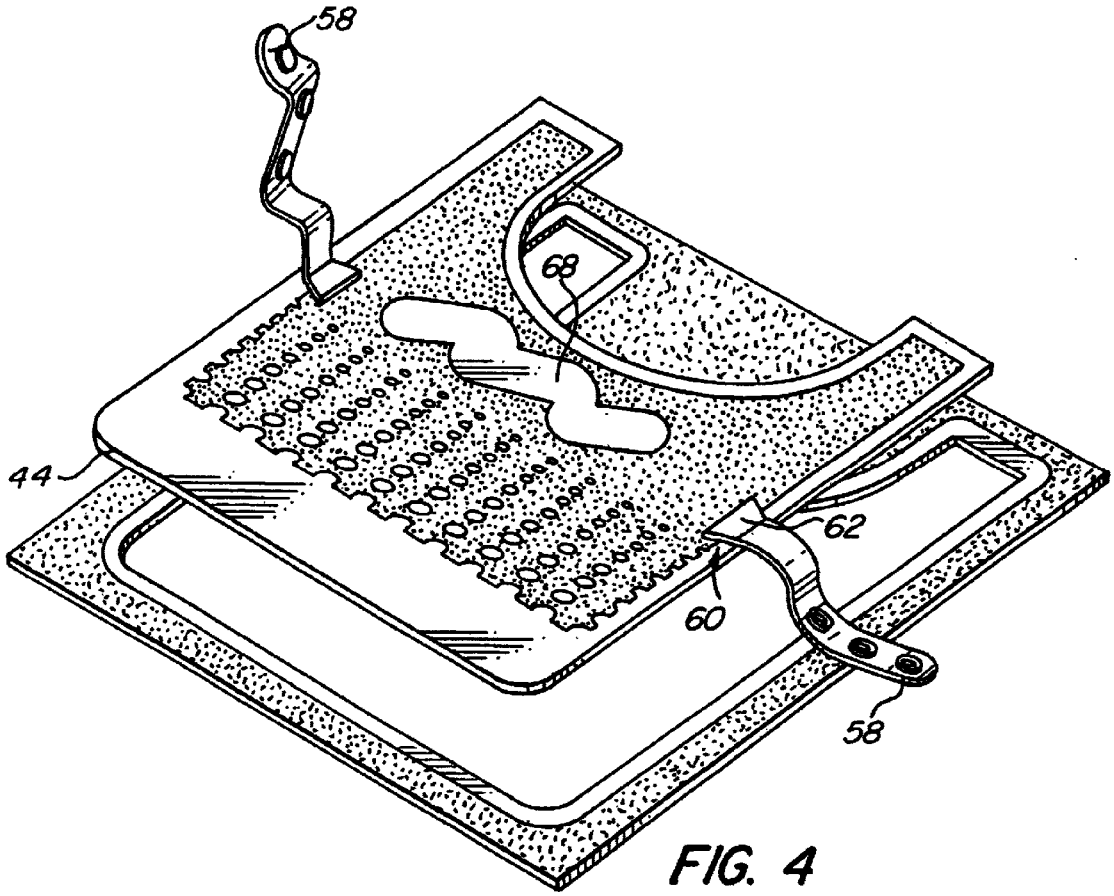
FIG. 4 is a perspective view of the vest panel of FIG. 2, which is diecut in accordance with the method of the invention.
Figure 5:
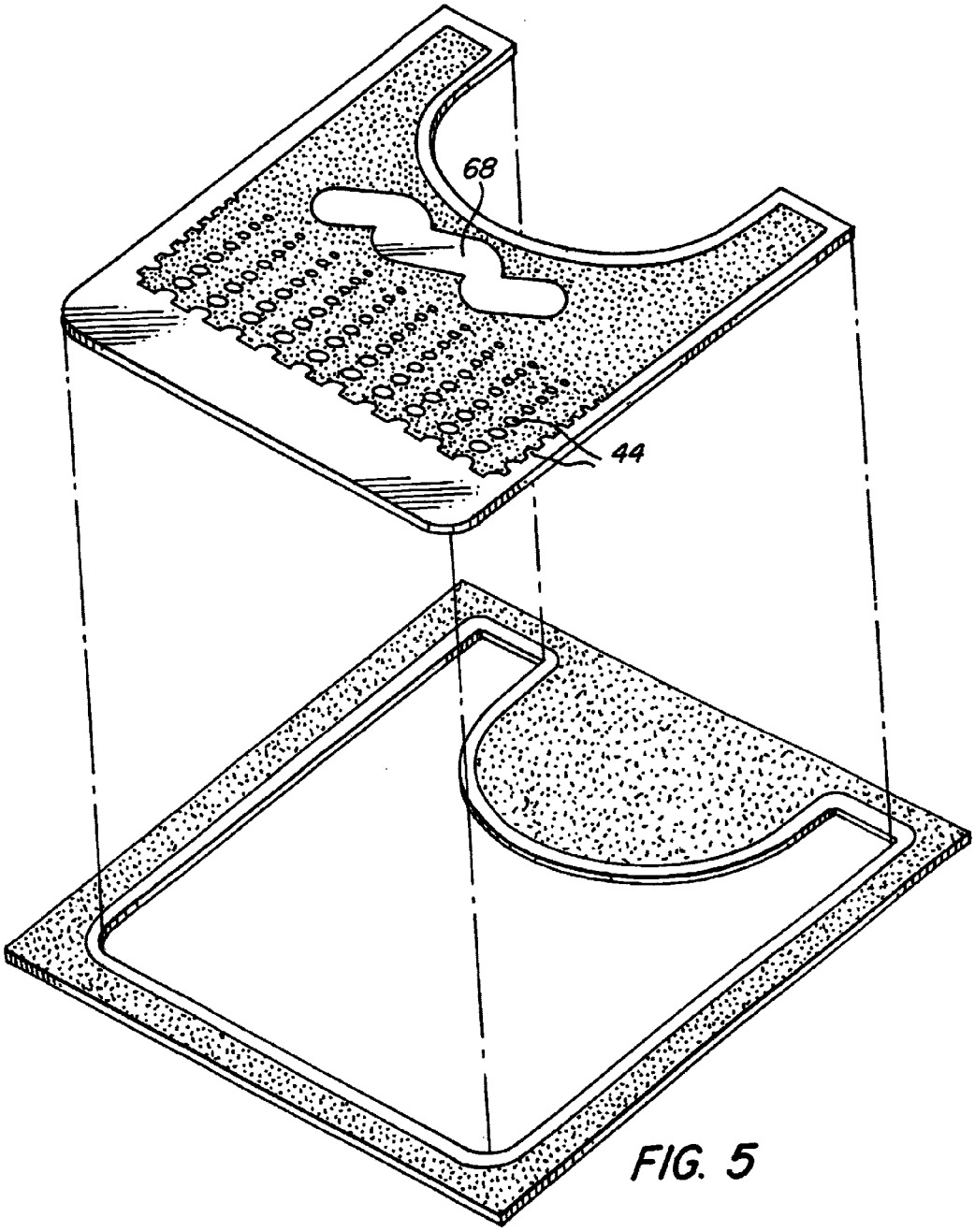
FIG. 5 is another perspective view of the vest panel in accordance with the invention.

Once the liquefied material has been applied and cured, a cured fabric part 44, as shown in FIGS. 4 and 5, is finally diecut at 46 (FIG. 1) in the die 30 (FIG. 6) which has peripheral steel edges 46 mounted to a wooden die base 45 and cutting through the peripheral reinforced zone 22 of the fabric part.

Figure 8:
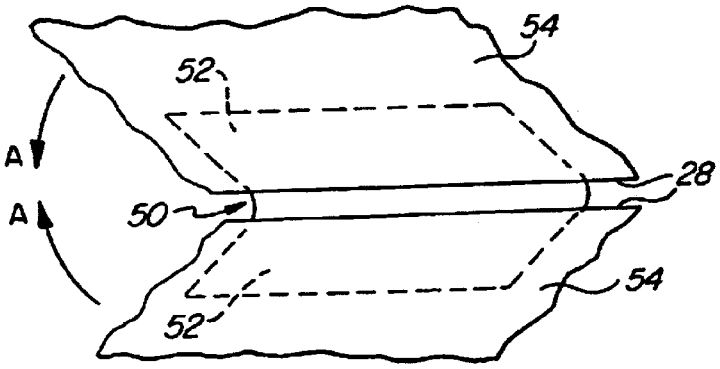
FIG. 8 illustrates a step of joining the cut parts together by means of a hinge.

The attachment of separate parts of the fabric product is accomplished by joining pre-selected segments of the peripheral edges 28 (FIG. 3) together after these parts are juxtaposed with one another. In accordance with the invention, a hinge 50 shown in FIG. 8, is bent to form a pair of vinyl narrow strips 52 each of which is welded to a segment 54 of the peripheral zone of the respective part of the fabric product after the parts are brought together, as shown by arrows A. The edges juxtaposed with one another can be located either immediately adjacent to one another or spaced apart at a small distance.

Preferably the edges are attached to the hinge by means of RF welding, vibration welding or sonic welding in a die, as disclosed in my co-pending application No. However, the hinge may also be sewn to the edges.

In addition, length-adjusting straps 58, shown diagrammatically in FIG. 4, are attached to the spaced apart segments of the peripheral edge 28 to provide a user with a convenient fastening means. Similarly to the attachment of the hinge, the straps may be welded or sewn to the reinforced fabric.

The straps also may be made of a light reflective material to provide practically the 360° visibility of a user in the dark. The fabric product can be decorated with reflective appliques 68 (FIGS. 4–6) which are attached to the product while the straps and the edges are being joined together.

Although the invention has been described with reference to a particular arrangements of parts, features and the like, these are not intended to exhaust all possible arrangements or features, and indeed many other modifications and variations will be ascertainable to those of skill in the art.

What is claimed is:

1. A process for manufacturing a fabric product comprising the steps of:

providing a layer of fabric;

applying a liquid polymeric material to the layer of fabric in accordance with a pre-selected pattern including at least a peripheral area;

applying the liquid polymeric material to another area of the layer of fabric in accordance with the pattern simultaneously with applying the liquid polymeric material to the peripheral area, thereby decorating the layer of fabric;

curing the polymeric material along the peripheral area, thereby polymeric material-strengthening the layer of fabric at least along the peripheral area;

cutting within and through the polymeric material-strengthened peripheral area to shape the layer, thereby forming a plastic seal around a peripheral edge of the shaped layer of fabric.

2. The process defined in claim 1, wherein the layer of fabric is selected from the group consisting of mesh material, cotton, nylon, polyester, and blends thereof.

3. The process defined in claim 1 wherein the polymeric material is applied to one of the opposite sides of the layer of fabric, the process further comprising the steps of applying the polymeric material to the other side of the layer of fabric along the peripheral area and curing the polymeric material being selected from the group consisting of plastisol liquid, puff plastisol liquid, vinyl liquid, UV-curable liquid and solvent based liquid.

4. The process defined in claim 1 wherein the step of applying the polymeric material to the layer of fabric is selected from the group consisting of screen-printing, flow molding, injection molding, and spray-painting.

5. The process defined in claim 4 wherein the polymeric material is applied to the layer of fabric in sections while the fabric is being unwound from a roll.

6. The process defined in claim 4 further comprising the step of cutting the fabric into separate pieces before applying the polymeric material to each individual piece.

7. The process defined in claim 1 wherein one side of the layer of fabric is placed on a non-stick base surface selected from the group consisting of a polytetrafluoroethylene material and a silicone treated release liner before applying the polymeric material, the process further comprising the step of covering the opposite side of the layer, which has the regions covered with polymeric material, with a top non-stick surface to provide a continuous pressurized contact between the opposite non-stick surfaces and the layer of fabric for a predetermined period of time at an elevated temperature, the polymeric material being flattened so it spreads out and is forced sideways, so all the polymeric material is cured and bonded together.

8. The process defined in claim 7 wherein the curing of the polymeric material is provided at 300–400° F. during the period of time ranging from 10 to 15 seconds, the bonded cured polymeric material being capable of filling and remaining in the holes of the mesh material after the layer has been removed from the non-stick surfaces.

9. The process defined in claim 1 wherein the step of curing is selected from the group consisting of heat-treating method, UV treating method and solvent evaporation method.

10. The process defined in claim 9 wherein the step of heat-treating includes moving the layer of fabric through a drying tunnel.

11. The process defined in claim 9 wherein the step of heat-treating includes press-heating the layer between a pair of heat-generating rotatable rollers.

12. The process defined in claim 11 wherein the step of press-heating includes placing the layer between two platens, each of which has a respective flat surface, and pressing the flat surfaces against the layer after the platens have been displaced toward one another.

13. The process defined in claim 1, further comprising the steps of providing a second layer of fabric, and joining the layers together along predetermined segments of the strengthened peripheral edges juxtaposed with one another.

14. The process defined in claim 13 wherein the step of joining the layers further includes providing vinyl hinges, each of which includes a respective pair of vinyl layers, flanking the juxtaposed segments of the strengthened peripheral edges with the respective pair of vinyl layers, and attaching the vinyl layers to the segments, thereby forming the fabric product which is selected from the group consisting of vests, tote bags, T-shirts, pillows, shorts, and books.

15. The process defined in claim 14 wherein the segments are attached to the hinges by means of a method selected from the group consisting of RF welding, sonic sealing, heating sealing, vibration welding, and sewing and a combination thereof.

16. The process defined in claim 1, further comprising the steps of:

attaching at least one length-adjusting strap to spaced apart segments of the strengthened peripheral edge of the layer of fabric, and attaching at least one light reflector to the layer.

17. The process defined in claim 16 wherein the steps of attaching the straps made of a reflective material and reflector are performed simultaneously.

18. The process defined in claim 1 wherein the layer of fabric is placed on a non-stick base surface selected from the group consisting of a polytetrafluoroethylene material and a silicone treated release liner before applying the polymeric material, and subsequently to the curing step, the layer of fabric material is peeled off the base, thereby leaving the excess of the cured polymeric material in the holes of the fabric.

19. A process for manufacturing a fabric product comprising the steps of:

providing a layer of fabric having a peripheral area;

applying a liquefied polymeric material to the layer in accordance with a pre-selected pattern, which includes at least the peripheral area, thereby forming a plastic seal along the peripheral area after the polymeric material has solidified;

applying the liquefied polymeric material to another area of the layer in accordance with the pattern simultaneously with applying the liquefied polymeric material to the peripheral area, thereby decorating the layer; and cutting the layer within and through the strengthened peripheral area to provide the shaped fabric product with a sealed-off reinforced peripheral edge.

20. The process defined in claim 19 wherein the step of applying the liquefied polymeric material includes:

applying a polymeric material to a transfer paper in accordance with the pre-selected pattern, curing the polymeric material;

interposing the transfer paper with the layer; and heat-transferring the cured polymeric material into the layer, thereby forming the reinforced peripheral area.

21. The process defined in claim 19 wherein the step of applying the liquefied polymeric material includes:

directly applying the liquefied polymeric material to the layer of the fabric in accordance with the pre-selected pattern; and curing the polymeric material, thereby forming the reinforced peripheral area on the layer of fabric.

* * * * *